US010759497B2

(12) United States Patent
De Giacomo

(10) Patent No.: US 10,759,497 B2
(45) Date of Patent: Sep. 1, 2020

(54) HIGH-SPEED HULL FOR A NAUTICAL VEHICLE

(71) Applicant: Maurizio De Giacomo, Milan (IT)

(72) Inventor: Maurizio De Giacomo, Milan (IT)

( * ) Notice: Subject to any disclaimer, the term of this patent is extended or adjusted under 35 U.S.C. 154(b) by 0 days.

(21) Appl. No.: 16/047,082

(22) Filed: Jul. 27, 2018

(65) Prior Publication Data

US 2020/0031429 A1 Jan. 30, 2020

(51) Int. Cl.
*B63B 1/32* (2006.01)
*B63B 1/34* (2006.01)
*B63B 3/38* (2006.01)

(52) U.S. Cl.
CPC . *B63B 1/34* (2013.01); *B63B 3/38* (2013.01)

(58) Field of Classification Search
CPC .... B63B 1/34; B63B 1/38; B63B 3/38; B63B 2001/34; B63B 2001/38; B63B 2003/38
USPC ..... 114/67 R, 67 A, 288, 289
See application file for complete search history.

(56) References Cited

U.S. PATENT DOCUMENTS 4,091,761 A 5/1978 Fehn
4,407,215 A * 10/1983 Cyr ..... B63B 1/38 114/271
6,125,781 A 10/2000 White
6,435,123 B1 * 8/2002 Ødegård ..... B63B 1/24 114/274
6,609,472 B2 * 8/2003 Burg ..... B63B 1/38 114/280
7,997,221 B2 * 8/2011 Costas ..... B63B 1/38 114/67 A
9,873,486 B2 * 1/2018 Jackson ..... B63B 1/121

FOREIGN PATENT DOCUMENTS

AU 764 670 B2 8/2003
EP 0 298 051 A1 1/1989
GB 1 025 454 A 4/1966
WO 01/79056 A1 10/2001

* cited by examiner

*Primary Examiner* — Daniel V Venne
(74) *Attorney, Agent, or Firm* — Vorys, Sater, Seymour and Pease LLP

(57) ABSTRACT

Provided is a hull of a boat including a central portion of a bottom of the hull, side portions of the bottom of the hull, lateral to the central portion of the bottom of the hull, the central portion of the bottom of the hull being substantially lowered in a substantially discontinuous way with respect to the side portions of the bottom of the hull, central side walls separating the central portion of the bottom of the hull from the side portions of the bottom of the hull. The hull also having external side walls laterally external to the side portions of the bottom of the hull.

13 Claims, 10 Drawing Sheets

HIGH-SPEED HULL FOR A NAUTICAL VEHICLE

TECHNICAL FIELD OF INVENTION

This invention relates to a hull of a nautical vehicle, such as a boat. In particular, the said vehicle may be any type of vessel, such as a boat, a ship, a sailboat, a motorboat, a sportsboat, a yacht and even a seaplane or similar boat.

DESCRIPTION OF THE PREVIOUS TECHNOLOGY

There are currently various known types of boat keels.

To describe the boats, in this document, the vertical direction marks the gravitational gradient (direction of gravity) when the boat is stationary on the water, which is in turn stationary or does not move. The longitudinal direction, perpendicular to the vertical direction, marks the direction of the progress of the boat, usually coinciding with the direction of the prevailing extension direction of the boat itself. The transverse direction is perpendicular to the longitudinal and vertical directions. The horizontal plane is the plane perpendicular to the vertical direction in which the transverse and longitudinal directions lie.

A particular type of boat is described for example in the patent documents AU-B-764670, GB-A-1025454, U.S. Pat. No. 4,091,761, EP-A-0298051, U.S. Pat. No. 6,125,781, WO-A-0179056, U.S. Pat. Nos. 3,698,342 and 6,112,687.

This type of boat comprises a bottom which, in the normal section perpendicular to the longitudinal direction, has a central, substantially lowered which is not continuous with respect to the side portions of the same bottom of the boat.

This central lowered portion of the hull provides the boat with a greater stability and a lower hydrodynamic impact, in comparison with other types of keels, for example with respect to keels with a continuous "V" bottom or similar.

The technique described above has some significant drawbacks.

In particular, despite the described improvements of the keels with a lowered central section, the boats continue to have a high hydrodynamic impact which translates into an increase in resistance to progress in the water, greater consumption and reduced comfort.

Furthermore, it would also be necessary to increase the horizontal stability of the hull itself during the movement of the boat.

SUMMARY OF THE INVENTION

In this situation, the technical task underlying this invention is to devise a hull for a nautical vehicle capable of substantially resolving the aforementioned drawbacks. As part of this technical task, an important aim of the invention to achieve a hull of a vehicle that has a reduced hydrodynamic impact during the progress of the boat itself.

Another important purpose of the invention is to achieve a hull of a nautical vehicle that is very stable during its progress.

The technical task and the specified purposes are achieved by a hull of a nautical vehicle in which the vehicle defines a vertical direction coinciding, both in the use of the vehicle and when it is stationary, with the gravitational gradient, a longitudinal direction, coinciding with the direction of the progress (direction of travel) of the vehicle, and perpendicular to the vertical direction, and a transversal direction perpendicular to the longitudinal direction and to the vertical direction and in which the hull comprises, in particular, a central portion of the bottom of the hull arranged in the centre along the transversal direction, extending over a large part of the hull itself along the longitudinal direction, the side portions of the bottom, lateral to the central portion of the bottom in a transversal direction, in which the central portion of the bottom is also lowered substantially and discontinuously with respect to the side portions of the bottom of the hull, and in which the hull also includes central side walls designed to separate the central portion of the bottom from the side portions of the bottom, external side walls, external to the side portions of the bottom, in which the external walls have, in view of the lateral plane parallel to the longitudinal direction and vertical direction, a portion defining a first concave upwards curve mainly in the bow half of the hull, central side walls which, in view of the lateral plane and in intersection with the side portions of the bottom in the bow section, a section defining a second curve with upward concavity, placed further towards the bow with respect to the first curve, and in which the side portions of the bottom join the first curve and the second curve through a portion which is at least partially curved.

BRIEF DESCRIPTION OF THE DRAWINGS

The characteristics and the advantages of the invention are clarified below by the detailed description of the preferred executions of the invention, with reference to the attached drawings, in which.

DESCRIPTION OF PREFERRED CONSTRUCTIONS

In this document, measurements, values, shapes and geometric references (such as perpendicularity and parallelism), when associated with words such as "roughly/about" or other similar terms such as "almost" or "substantially", are to be understood, to a lesser extent, as measurement errors or inaccuracies due to production and/or manufacturing errors and, above all, as a slight divergence from the value, measurement, geometric shape or reference with which it is associated. For example, these terms, if associated with a value, ideally indicate a divergence of no more than 10% of the value.

Moreover, when used, terms such as "first", "second", "higher/upper", "lower", "primary" and "secondary" do not necessarily identify an order, a relationship priority or relative position, but can simply be used to more clearly distinguish between their different components.

With reference to the Figures, the hull of a nautical vehicle according to the invention is globally indicated by the number 1.

It constitutes part of a nautical vehicle 100 of any type, such as, in particular, a boat of any type such as a sailboat, a yacht, or a sportsboat such as a canoe, kayak or similar. Or a seaplane or similar.

In detail, FIGS. 3*a*-3*f* illustrate a kayak to scale.

FIGS. 2*a*-2*c* and 7 show motorboats for a few people.

Figure 5:
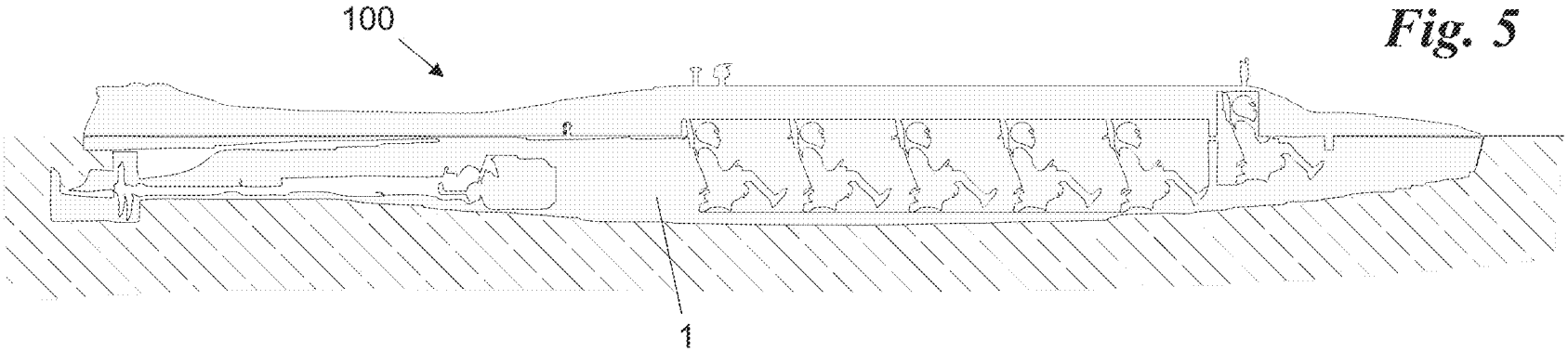
FIG. 5 shows a side view of a military craft including a hull according to the invention.
Figure 6:
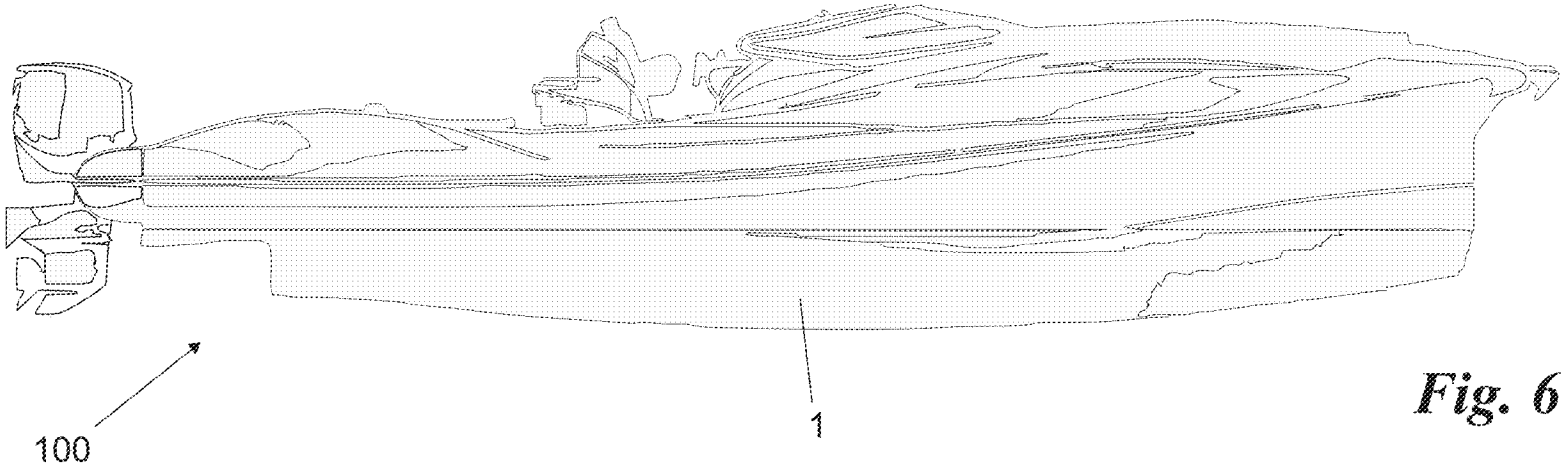
FIG. 6 shows a side view of a boat consisting of a dinghy including a hull according to the invention.
Figure 7:
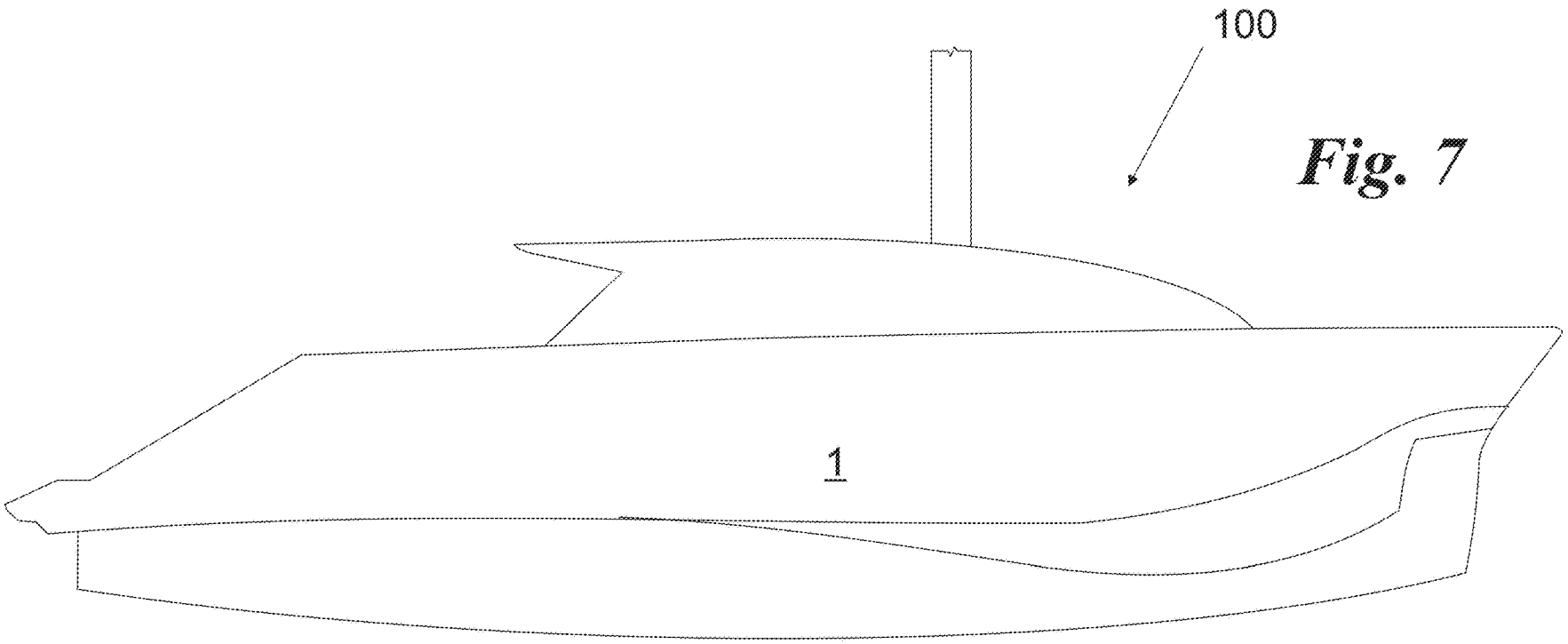
FIG. 7 shows a side view of a vessel consisting of a sailboat including a hull according to the invention.

FIG. 5 shows a boat for military use and FIG. 6 shows a dinghy.

As previously mentioned, in this document the vertical direction 1*c* will mark the gravity direction when the vehicle is stationary on the water and when the water is calm or stationary. The longitudinal direction 1*a*, perpendicular to the vertical direction, marks the progress direction (direction of travel) of the nautical vehicle 100, usually coinciding with the direction of the prevailing extension of the vehicle 100 itself. The transverse direction 1*b* is perpendicular to the longitudinal direction 1*a* and vertical direction 1*c*. The horizontal plane is the plane perpendicular to the vertical direction on which the transverse and longitudinal directions lie.

It is also known that the hulls 1 have a bow point or bow, which is the most frontal or forward point, of the hull 1, along the longitudinal axis 1*a*, and a stern point or stern, which is the most rearward or rearmost point along the longitudinal axis 1*a* of the hull 1.

Figure 1:
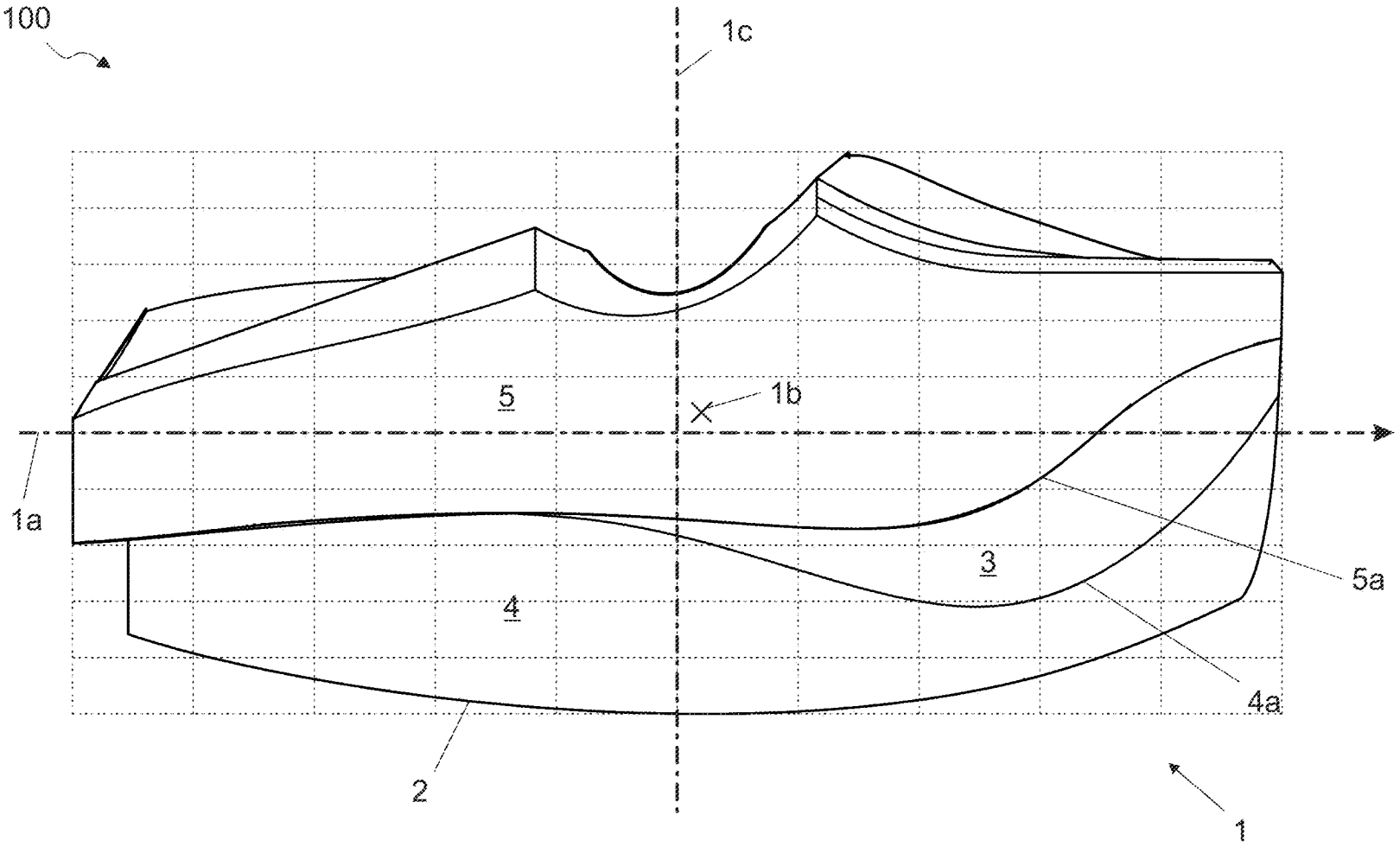
FIG. 1 shows a compressed side view, in the longitudinal direction, of a boat comprising a hull according to the invention.
Figure 2B:
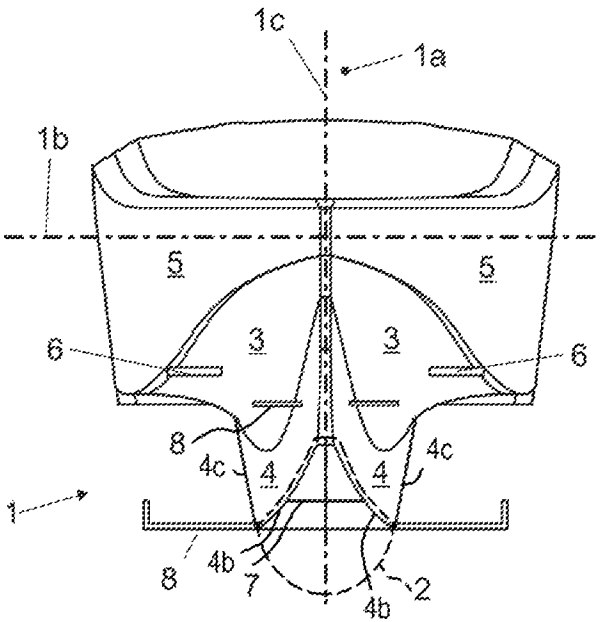
FIG. 2*b* is a front view of the boat of FIG. 2*a;*
Figure 2A:
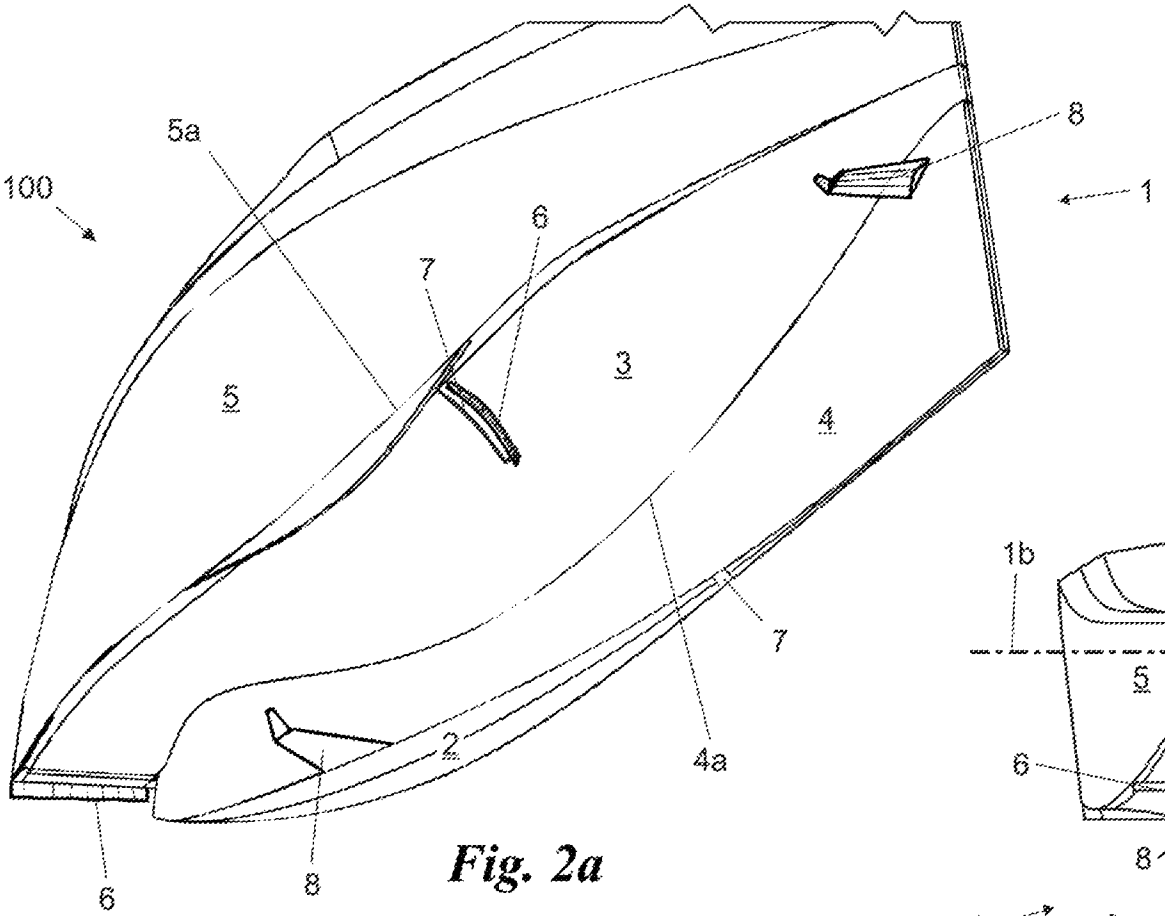
FIG. 2*a* shows an axonometric view from below of a first example of a boat comprising a hull as per the invention.
Figure 2C:
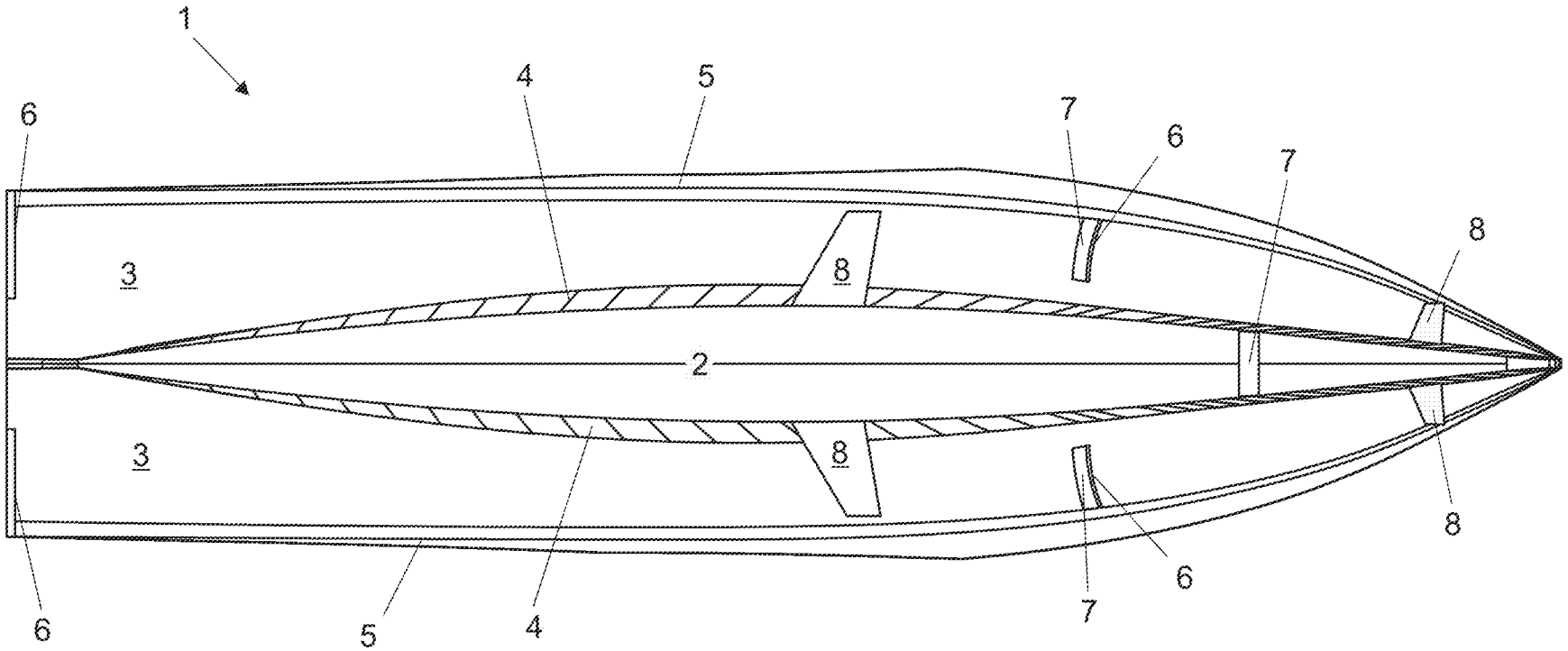
FIG. 2*c* shows a view from below the boat of FIG. 2*a;*
Figure 3A:
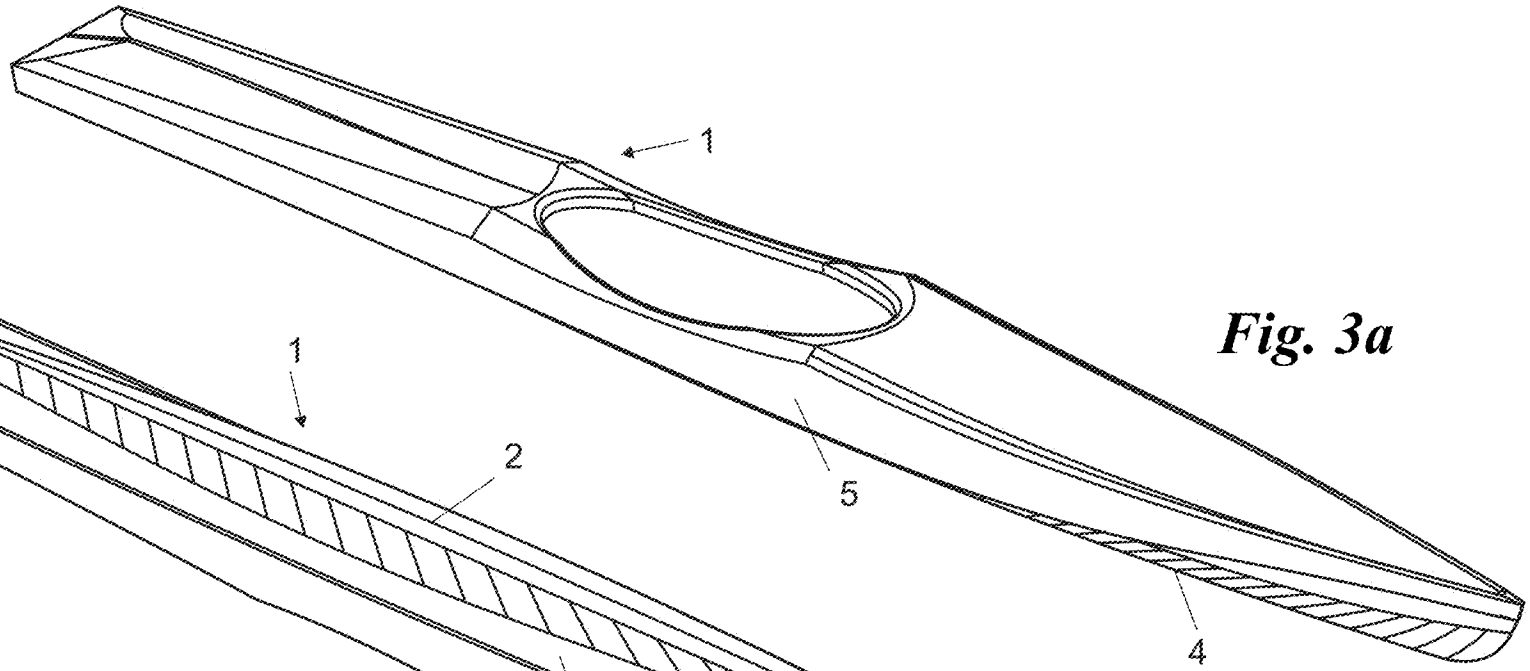
FIG. 3*a* illustrates an axonometric view from above a second example of a vessel comprising a hull as per the invention.
Figure 3B:
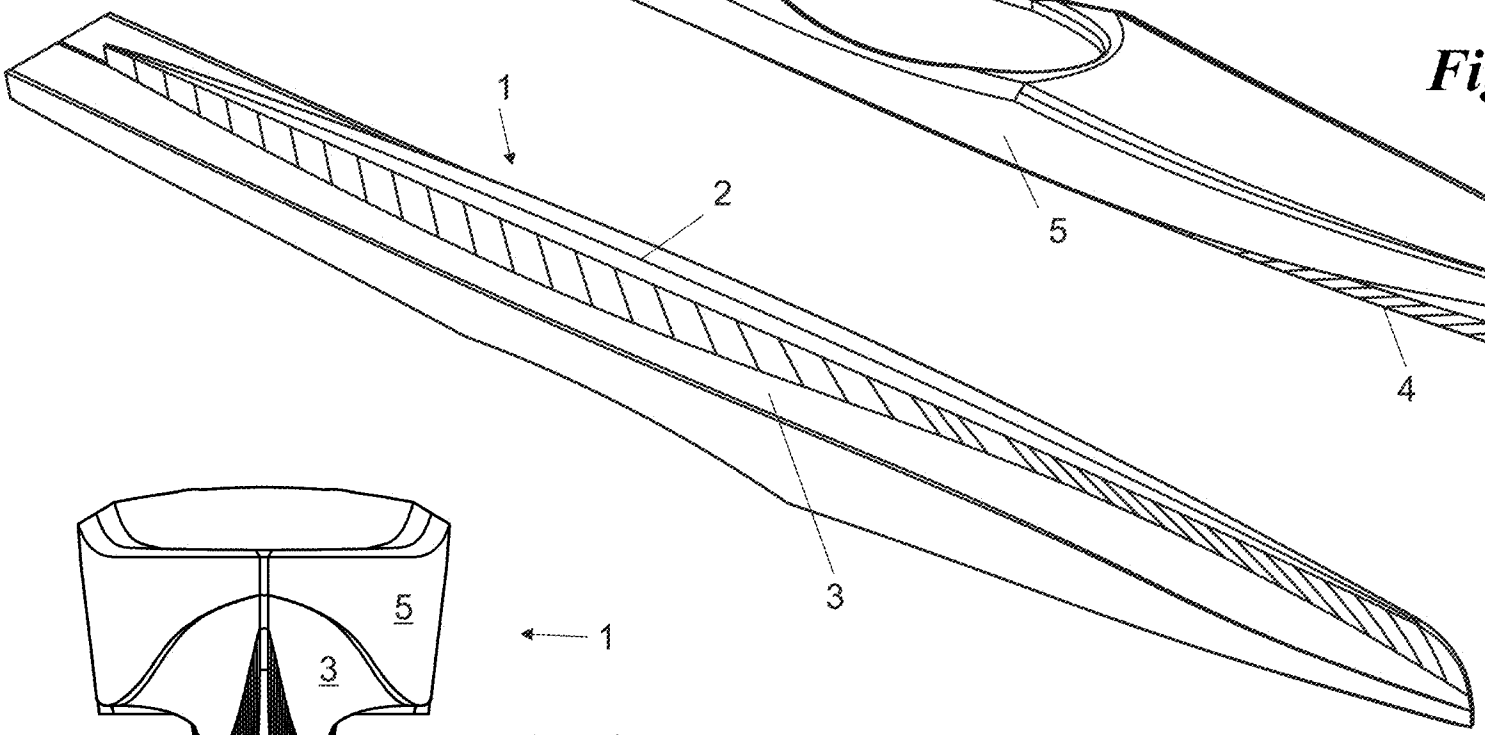
FIG. 3*b* is an axonometric view from below the boat in FIG. 3*a;*
Figure 3C:
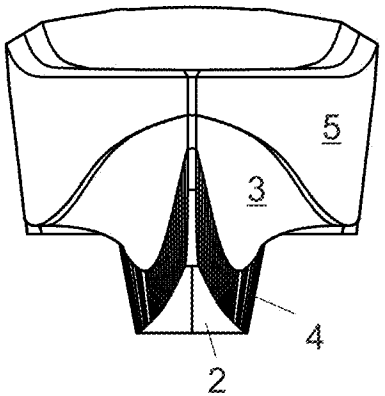
FIG. 3*c* shows a front view of the boat in FIG. 3*a;*
Figure 3D:
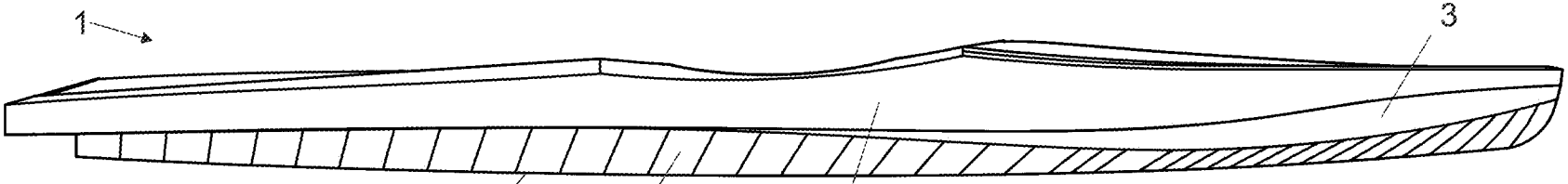
FIG. 3*d* shows a side view of the boat in FIG. 3*a;*
Figure 3E:
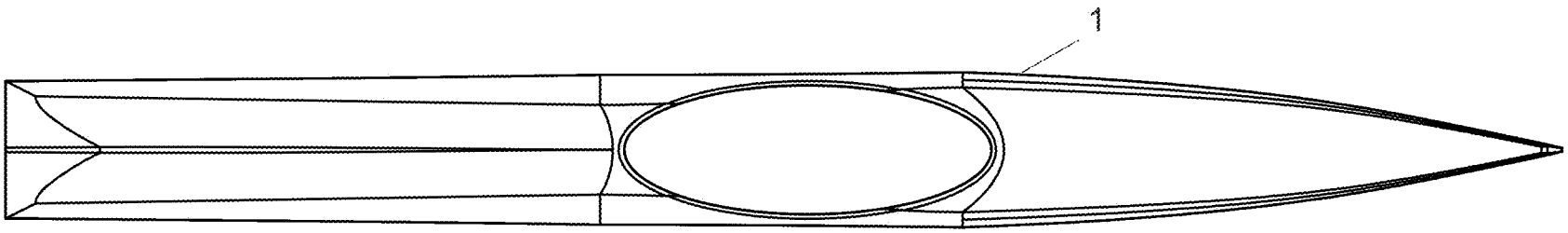
FIG. 3*e* is a top view of the boat in FIG. 3*a;*
Figure 3F:
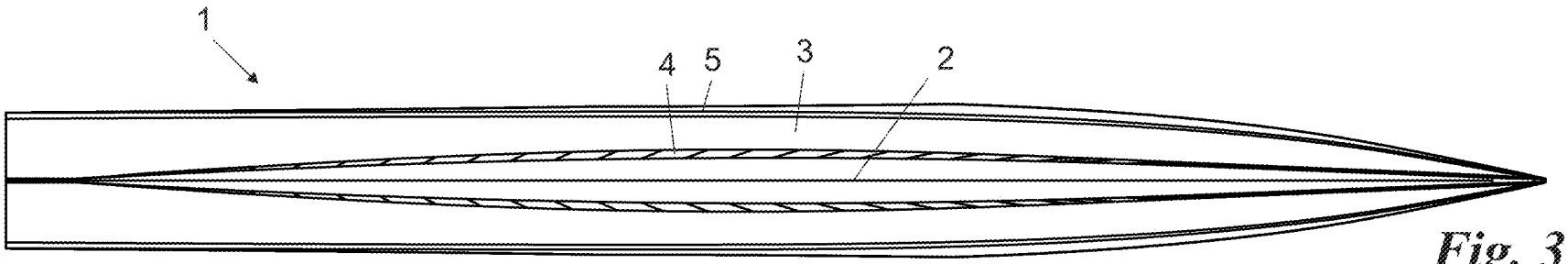
FIG. 3*f* shows a bottom view of the boat in FIG. 3*a;*

In addition, to define the positions along the longitudinal axis 1*a*, the hull 1 will be divided into sections, such as, for example, the half of the prow, which is the portion of the hull 1 which starts from the middle of the nautical vehicle, e.g., ship, and reaches the bow, the half of the stern, which is the portion of the ship which starts from the middle of the ship and reaches the stern, the first tenth from the bow, the second tenth from the bow, which are the portions which, dividing the nautical vehicle, e.g., ship, into ten portions, are the closest to the bow and including this and the portion immediately following. To facilitate understanding in FIG. 1, the hull of a kayak is shown compressed longitudinally and divided into dotted lines which each correspond to one-tenth of the total length or height of the hull 1. The measurements relating to the aforesaid figure therefore serve as a description of a preferred example.

The hull 1 comprises a central portion of the bottom 2 of the hull which occupies, in the transverse direction 1*b* and in section or seen in the plane perpendicular to the longitudinal axis 1*a*, the central portion of the bottom of the hull 1. The central portion of bottom 2 extends over a large part of the hull 1. Ideally, the central portion of bottom 2 shall extend, in the longitudinal direction 1*a* from the bow up to and including the ninth tenth of the hull 1. The central portion of bottom 2 may also have an extension in the transversal direction 1*b*, so that in the frontal view (FIG. 2*b*, FIG. 3*c*) the outline of the boat has a substantially "V-shaped" bottom. This variant is particularly advantageous for seaplanes.

The hull 1 further comprises side portions of the bottom 3, which are, in the transversal direction 1*b* and in section or view in the normal plan to the longitudinal axis 1*a*, lateral to the central portion of bottom 2. They shall ideally occupy the whole bottom of the hull 1, with the exception of the central portion of bottom 2.

The central section of bottom 2 is also lowered substantially and discontinuously with respect to the side portions of bottom 3. The phrase "substantially and discontinuously" is understood to be mean the difference between the average level or height, in the vertical direction, between the two central portions of the bottom 2 and the side portion of the bottom 3 visible and, for example, equal to at least one-tenth or better one-fifth of the width, in the transverse direction 1*b*, of the hull 1. Viewed from below, the central portion of bottom 2 has a tapered section at the ends and a maximum section at the centre which is ideally curved and continuous and essentially an ogival arch shape. Conveniently, near the centre in longitudinal direction 1*a* of the vehicle 100, the width in the transversal direction 1*b* of the central portion of bottom 2 shall be close to the width of each side portion of bottom 3.

The bottom of the hull 1 also has an essentially constant total width from the middle to the stern and tapers substantially towards the bow.

Also the height, in the vertical direction 1*c*, of the central portion of bottom 2 is preferably substantially constant and more preferably substantially concave towards the top.

The hull 1 also includes central side walls 4 designed to separate the central portion of bottom 2 from the side portions of bottom 3. These central side walls 4 are ideally parallel or slightly diverging, and preferably inclined, with respect to the vertical direction (vertical axis) 1*c*, less than 30° degree and more preferably between 5° and 15°. The central side walls comprising opposed inner central side walls 4*b* defining the central portion there between and opposed outer side walls 4*c*, the central side walls comprising opposed outer central side walls. The opposed inner central side walls each having longitudinally front and back ends relative to the direction of advancement of the boat, wherein the front ends of the opposed inner central side walls meet, wherein the back ends of the opposed inner central side walls meet. The opposed outer central side walls each having longitudinally front and back ends relative to the direction of advancement of the boat, wherein the front ends of the opposed outer central side walls meet, wherein the back ends of the opposed outer central side walls meet.

The hull 1 also comprises external side walls 5 external to the side portions of bottom 3 and basically consisting of the side walls of the hull 1.

The outer walls 5 have, in view of the lateral plane parallel to the longitudinal direction 1*a* and vertical direction 1*c*, a portion defining a first curve 5*a* with predominantly upwards concavity, upwards and which is preferably essentially total, in the bow half of the hull 1.

Moreover, the central side walls 4 have, always in view of the said lateral plane and in the bow section, a portion defining a second curve 4*a* with upward concavity, placed more towards the bow than the first curve 5*a* and ideally with a minor average radius of lesser curvature. The average radius of the curve is evaluated because the two curves 4*a* and 5*a* may not be perfect circumference arcs and may therefore have a varying diameter.

Moreover, the side portions of bottom 3 shall join the first curve 5*a* and the second curve 4*a* through a portion that is at least partly curved. The said curve has a downward concavity and ideally a greater radius of curvature in proximity to the central portion of bottom 2.

Moreover, said second curve 4*a* preferably defines a portion of lower height, in the vertical direction 1*c*, with respect to the rest of the external side walls 5.

The stern portion, ideally at least the last 10th or the last fifth, of the side portions of bottom 3 is instead substantially flat and preferably slightly downwards inclined.

The bow is preferably higher than the other portions, as is usual.

The hull 1 furthermore ideally comprises the interceptors 6.

As is known, the interceptors are spoilers or flat portions extending substantially along the transversal plane and preferably mainly in the transversal direction 1*b*. They are designed to create depressions capable of reducing hydrodynamic friction.

The hull 1 shall include interceptors 6 arranged on the side portions of the bottom 3 at least in correspondence with the partially-curved portion joining the first curve 5*a* and the second curve 4*a*. They ideally occupy the outermost half of the side portions of the bottom 3.

The hull 1 also ideally comprises interceptors 6 arranged at the bow of the hull.

The hull 1 also includes air intakes 7 constituting the open channels, on one side, in line with the side portions of the bottom 3 and, on the other side, of a portion exposed to the air. When the boat is moving, the air that passes through the aforementioned channels arrives at the bottom of the boat due to the localised depression.

In this way, natural air lubrication is achieved by the generation of a dynamic air cushion also known as DYNAC or "Dynamic Natural Air-Cushion".

These air intakes 7 should preferably have openings at the partially-curved portion joining the first curve 5*a* and the second curve 4*a*. Moreover, they are preferably placed closely and behind, preferably immediately behind, the interceptors 6 arranged on the lateral portions of the bottom 3 in line with the partially-curved portion which joins the first and second curves 5*a* and 4*a*. In addition, the air vents 7 in the vicinity of interceptors 6 preferably have the same width as interceptors 6, in the transversal direction 1*b*.

A further air vent 7 can be placed in the bow half of the hull 1 in line with the central portion of bottom 2.

Finally, the hull 1 includes foils 8. As is known, the foils are ailerons that extend mainly along the horizontal plane and are used mainly to increase the lift and stability of the hull 1.

The foils 8 are arranged at least in the central portion of the hull 1 and ideally also near the bow.

Finally, the boat may include spray rails, i.e. flat or wedge shaped portions in the normal section which extend mainly parallel to the longitudinal axis 1*a* and the vertical axis 1*c* and downwards and are arranged at the bottom of the side portions of bottom 3 and at the ends of the portions.

Figure 10:
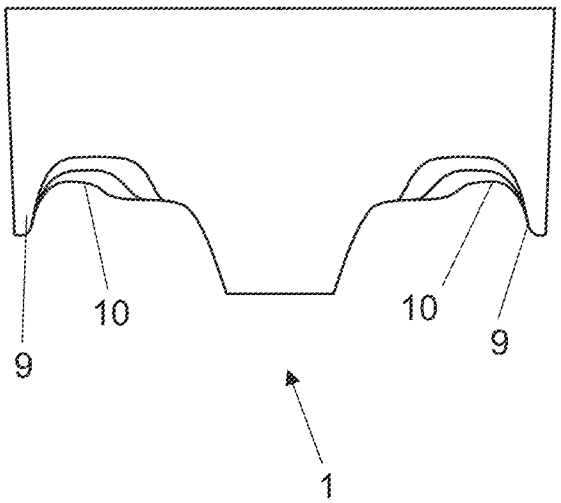
FIG. 10 shows a normal section of the hull according to the invention in a variant.
Figure 9:
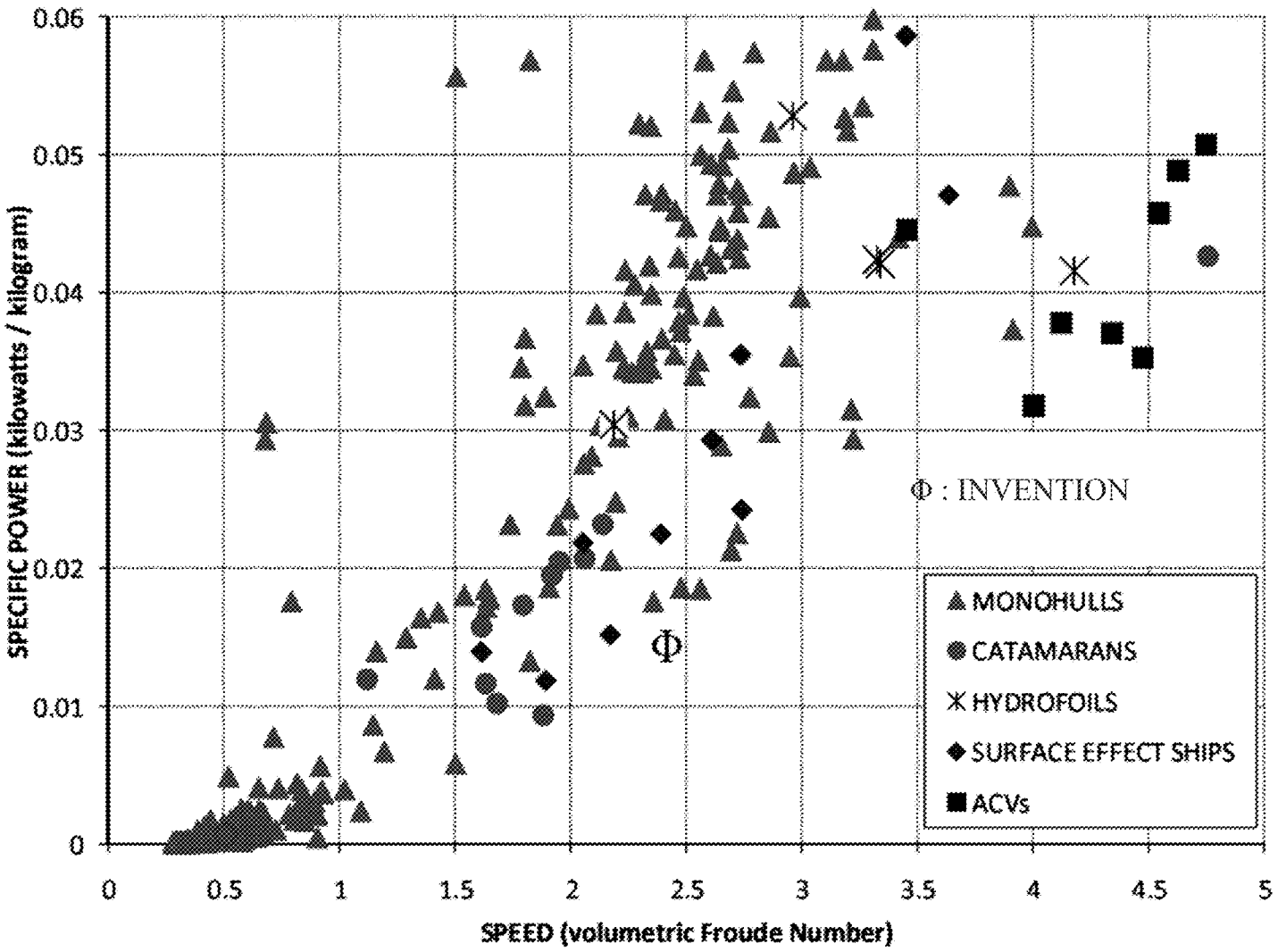
FIG. 9 shows an additional graph of the results given by a boat including a hull according to the invention, as compared to traditional hulls.

The hull 1 can also include side skirts 9, consisting of extensions towards the bottom of the hull sides, as visible in FIG. 10. These side skirts 9 increase the lateral stability of the hull. These miniskirts have the function of trapping the air conveyed by the two tunnels 10, which gradually compresse due to the variation of the section from Bow to Stern.

The hull 1, as per the invention, achieves important advantages.

Figure 4A:
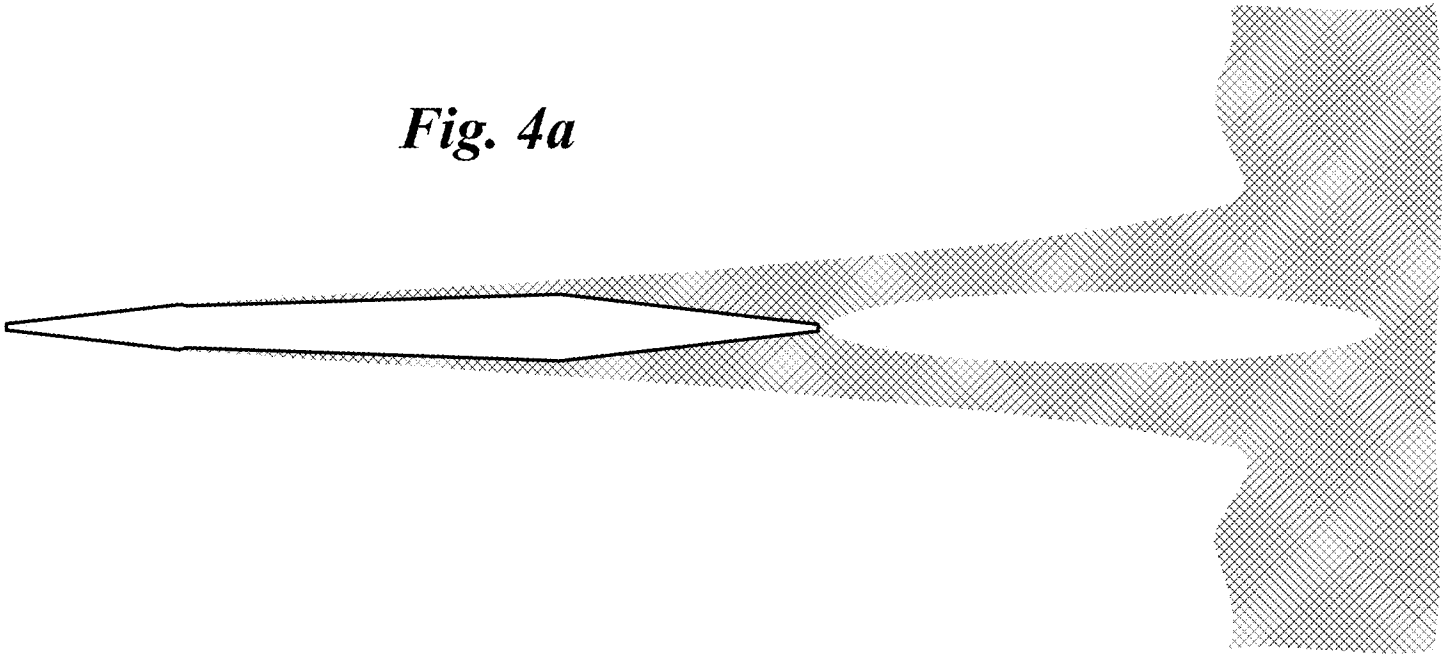
FIG. 4*a* shows a CFD analysis of a hull in accordance with the noted technology.
Figure 4B:
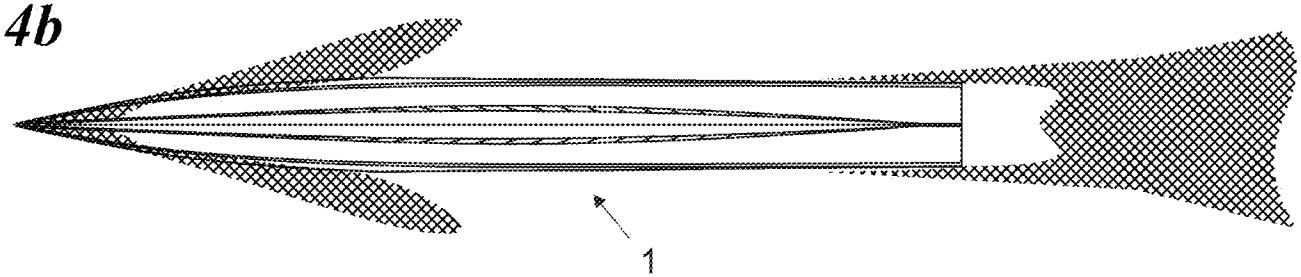
FIG. 4*b* shows a CFD analysis of a hull according to the invention.

In fact, the front portion of the boat, including the aforementioned curves 4*a* and 5*a* and the side portions of bottom 3, create a depression in the stern half of the hull which considerably reduces the hydrodynamic friction. In addition, the side portions of base 3 create a depression in the bow half of the hull (allowing air blow-in) and greatly reduce the hydrodynamic friction. For example, FIG. 4*a* shows a CFD (Computational Fluid Dynamics or numerical fluid dynamics) analysis of a hull in accordance with the current technology, in particular of a kayak, compared to a hull 1 as per the invention, in FIG. 4*b*, in particular the hull of a kayak constructed in accordance with the invention. In these figures the areas with high hydrodynamic friction are marked with filled-in areas. It is possible to analyse how the high-friction areas caused by the hull 1 according to the invention are significantly lower.

It is believed that the particular advantages are conferred by the described curvatures which create a depression in the bow half of the hull 1.

This hydrodynamic advantage is also increased, in particular with regard to the specific shape of the hull 1, by the interceptors 6 and the air vents 7. The interceptors 6 and the air intakes 7 act in synergy in the curved area, increasing the bearing capacity and stability of the boat.

Moreover, said foils 8 improve the stability of the hull 1; in particular they adapt to the described shape which confers stability in the areas of the foils 8.

The air vents 7 act in the depression zone following the curved area and increase the airflow.

These benefits also include a reduction of the bow wave.

In addition, the design of the hull 1 also achieves other important advantages.

For example, if applied to a motorboat, or a sailboat or a seaplane, of any size, the lowered portion allows one to accommodate the engine room of the boat and free up more space in the upper area.

Moreover, if used for military purposes, the aforementioned hull 1, thanks to its hydrodynamic shape, allows the boat to be immersed more deeply in the water and thus achieves a boat which is less visible on the water, while still maintaining a reduced hydrodynamic footprint, as illustrated in FIG. 5. In particular, this is a type of vessel commonly known as: special operation vessel.

Figure 8:
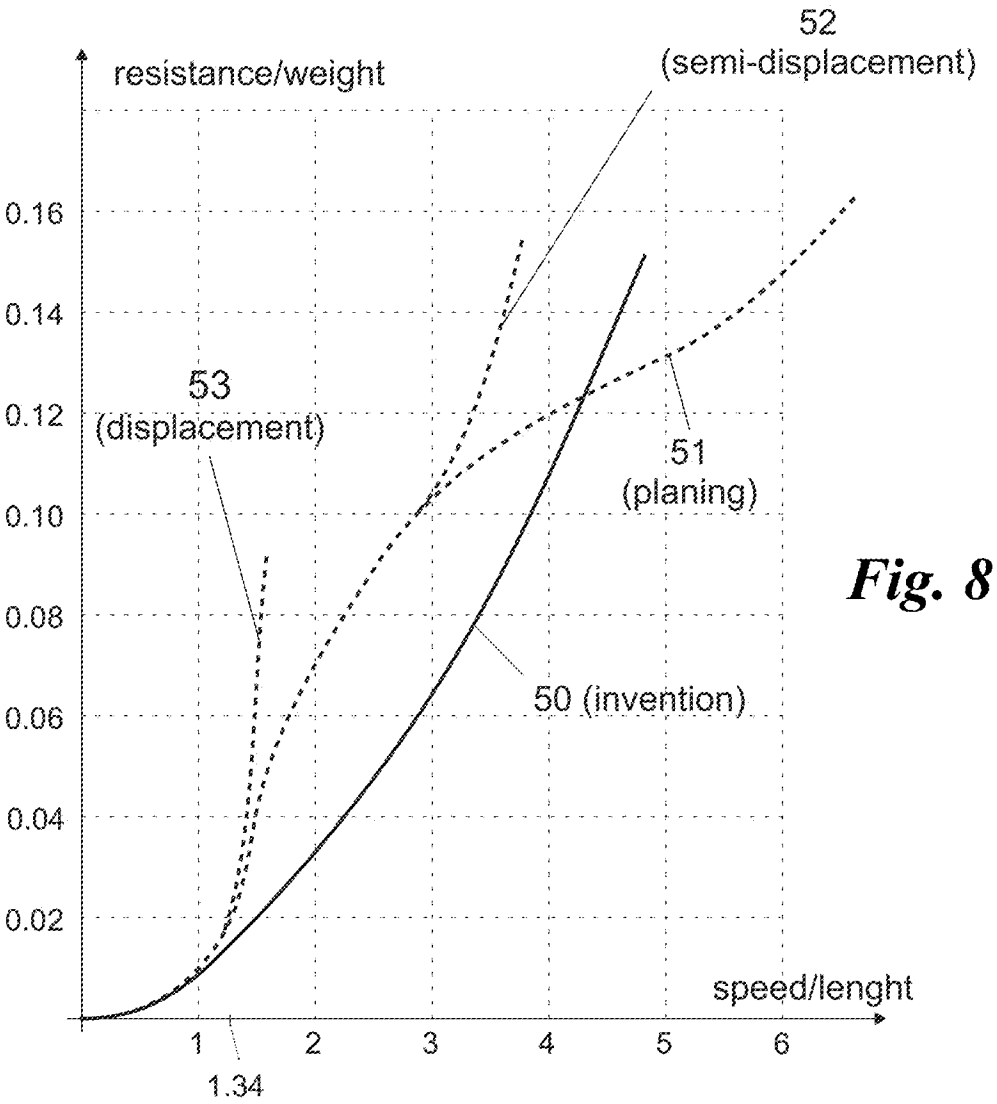
FIG. 8 shows a graph of the results given by a boat including a hull according to the invention as compared to traditional hulls.

Moreover, the combination of advantages inherent in the design allows for an increase in the habitability by 25% in comparison with the known designs of boats. The graph in FIG. 8, which illustrates the ratio of speed to length in abscissa and the ratio of resistance to weight in the ordinate, shows the best performance of keel 1 (curve 50) compared to a boat of the "displacement" type (curve 53), a "semi-displacement" vessel (curve 52) and a "Planing"-type boat.

In FIG. 10, instead, the speed (on the abscissa) of a boat with a hull 1 according to the invention is compared to traditional vessels, with respect to the specific power (in ordinate) used.

The invention is subject to variations falling within the scope of the inventive concept defined by the claims.

In this context all the details can be substituted by equivalent elements and the materials, the shapes and the dimensions can vary.

The invention claimed is:

1. A hull of a nautical vehicle, comprising a bow, a stern, a vertical axis, in use and with the nautical vehicle stationary, coinciding with a gravity gradient, a longitudinal axis, coinciding with a direction of advancement of the nautical vehicle, defining a direction of travel, and perpendicular to the vertical axis, a transverse axis perpendicular to the longitudinal axis and to the vertical axis, a hull bottom, and hull opposed external side walls, wherein the hull bottom comprises:

a central portion disposed in a centre of the hull bottom along a transverse direction, the central portion extending from a bow of the hull along a length of the hull along the longitudinal axis, side portions of the hull bottom, lateral to the central portion of the hull bottom in the transverse direction, central side walls comprising downwardly opposed inner central side walls, the central side walls further comprising opposed outer central side walls, the downwardly extending opposed inner central side walls defining the central portion of the hull bottom there between and separating the central portion of the hull bottom from said side portions of the hull bottom, the opposed inner central side walls each having longitudinally front and back ends relative to the direction of advancement of the nautical vehicle, wherein front ends of the opposed inner central side walls meet, wherein back ends of the opposed inner central side walls meet, the opposed outer central side walls each having longitudinally front and back ends relative to the direction of advancement of the boat, wherein the front ends of the opposed outer central side walls meet, wherein the back ends of the opposed outer central side walls meet, the opposed inner central side walls defining the central portion define a concave with a substantially inverse V-shaped transverse cross-section and lowered substantially and discontinuously with respect to the side portions, wherein the hull opposed external side walls are lateral to the side portions of the hull bottom and extend upwardly from the side portions of the hull bottom;

wherein the hull opposed external side walls have, a side profile as viewed parallel to the longitudinal axis and the vertical axis, a portion defining a first curve (5*a*) with upward concavity mainly in a bow half of the hull, wherein the outer central side walls have, at an intersection with the side portions in a bow portion, a portion defining a second curve (4*a*) with upward concavity, placed further toward the bow with respect to the first curve, wherein the side portions of the hull bottom each joining the first curve and said second curve through a portion of a respective side portion which is at least partly curved.

2. The hull according to claim 1, wherein said second curve has an average radius of curvature which is lower than that of said first curve.

3. The hull according to claim 1, in which a portion of the stern of said side portions of the hull bottom is substantially flat.

4. The hull according to claim 1, including interceptors arranged on the side portions of the hull bottom which are provided for the partly curved portion joining said first and second curves.

5. The hull according to claim 4, wherein said interceptors are also arranged at the stern of said hull.

6. The hull according to claim 4, comprising air vents defining open channels, on one side, in line with said side portions of the hull bottom and, on a second side, in line with a portion which is adapted and configured to be exposed to air during use of the nautical vehicle, and in which the air vents are opened in proximity to and behind the interceptors arranged on the said side portions of the hull bottom, in line with said at least partly curved portion joining said first and second curves.

7. The hull according to claim 1, comprising an air intake forming an open channel having a first end located in the central portion of the hull bottom and in the bow half of the hull and a second end located to expose the air intake to the air during use of the nautical vehicle.

8. The hull according to claim 1, including foils arranged at least in the central portion of the hull.

9. The hull according to claim 1, in which said foils are also arranged near a prow of the hull.

10. The hull according to claim 1, wherein the central portion of the hull bottom is substantially flat along the transverse direction.

11. A nautical vessel selected from the group consisting of a boat, a ship, a sailboat, a motorboat, a sports boat, a yacht and a seaplane and including a hull according to claim 1.

12. The hull according to claim 6, further comprising an airflow portion comprising side air intakes defining a respective open channel inlet in line with said side portion and located on a first side of the airflow portion and an outlet, located on a second side of the airflow portion, the airflow portion adapted and configured exposed to the air during use of the nautical vehicle, for passing air therethrough when the air arrives at the hull bottom due to a localized depression when the nautical vehicle is moving, wherein the air intakes have openings at the portion which is at least partly curved joining the first curve (5*a*) and the second curve (4*a*).

13. The hull according to claim 12, further comprising a central air vent placed in the bow half of the hull in line with the central portion of the hull bottom.

* * * * *